US011024147B2

(12) United States Patent
Mandl et al.

(10) Patent No.: US 11,024,147 B2
(45) **Date of Patent: *Jun. 1, 2021**

(54) SYSTEM AND METHOD FOR SURVEILLANCE

(71) Applicant: Infineon Technologies AG, Neubiberg (DE)

(72) Inventors: Christian Mandl, Munich (DE); Waldemar Marsetz, Munich (DE)

(73) Assignee: Infineon Technologies AG, Neubiberg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/419,433

(22) Filed: May 22, 2019

(65) Prior Publication Data

US 2019/0362613 A1 Nov. 28, 2019

(30) Foreign Application Priority Data

May 24, 2018 (EP) ..... 18174176

(51) Int. Cl.

| | |
|---|---|
| ***G08B 21/00*** | (2006.01) |
| ***G08B 21/18*** | (2006.01) |
| ***G08B 7/06*** | (2006.01) |
| ***G10L 25/51*** | (2013.01) |

(52) U.S. Cl.
CPC ..... *G08B 21/182* (2013.01); *G08B 7/06* (2013.01); *G10L 25/51* (2013.01)

(58) Field of Classification Search
CPC ..... G08B 21/182; G08B 7/06; G10L 25/51
USPC ..... 340/626
See application file for complete search history.

(56) References Cited

U.S. PATENT DOCUMENTS

| | | | | |
|---|---|---|---|---|
| 4,692,743 | A * | 9/1987 | Holden | G08B 13/20 340/544 |
| 9,594,163 | B2 * | 3/2017 | Park | G08B 19/00 |
| 9,980,023 | B1 * | 5/2018 | Fallon | H04R 1/222 |
| 2002/0191802 | A1 * | 12/2002 | Choe | H04R 23/00 381/92 |
| 2003/0090377 | A1 * | 5/2003 | Pieper | G08B 13/1681 340/566 |

(Continued)

FOREIGN PATENT DOCUMENTS

| | | | |
|---|---|---|---|
| GB | 2302406 | A | 1/1997 |
| GB | 2451241 | A | 1/2009 |

(Continued)

*Primary Examiner* — Zhen Y Wu
(74) *Attorney, Agent, or Firm* — Slater Matsil, LLP

(57) ABSTRACT

In accordance with an embodiment, a system for surveillance includes an audio signal analyzer, wherein the audio signal analyzer is configured to receive one or more audio microphone signals, where the audio signal analyzer is configured to determine a pattern matching result by determining whether the one or more microphone signals comprise at least one audio pattern of one or more predefined audio patterns; an air pressure change determiner, where the air pressure change determiner is configured to receive an air pressure change signal indicating an air pressure change; and an evaluator, wherein the evaluator is configured to indicate, depending on the pattern matching result and depending on the air pressure change, that a predefined event occurred.

19 Claims, 10 Drawing Sheets

(56) References Cited

U.S. PATENT DOCUMENTS

2004/0212503 A1* 10/2004 Stilp ..... G08B 29/14 340/572.1
2005/0078006 A1* 4/2005 Hutchins ..... G08B 13/2454 340/561
2007/0237358 A1* 10/2007 Tseng ..... G08B 13/19608 382/103
2008/0037433 A1* 2/2008 Sotack ..... H04M 1/72538 370/242
2009/0022362 A1* 1/2009 Gagvani ..... G06T 7/254 382/100
2011/0141283 A1* 6/2011 Lee ..... G08B 13/19695 348/152
2012/0087211 A1* 4/2012 Lee ..... G08B 13/1609 367/93
2013/0162821 A1* 6/2013 Park ..... G08B 13/1672 348/143
2013/0250729 A1* 9/2013 Park ..... G01S 15/04 367/87
2014/0307096 A1* 10/2014 Park ..... G01S 15/02 348/152
2015/0279181 A1* 10/2015 Park ..... G08B 17/00 367/136
2015/0309459 A1* 10/2015 Watanabe ..... G03G 15/5029 399/45
2016/0277863 A1* 9/2016 Cahill ..... H04R 3/005
2017/0188136 A1* 6/2017 Kwon ..... H04R 1/288
2017/0205232 A1* 7/2017 Shirai ..... G01C 5/06
2018/0035200 A1* 2/2018 Abe ..... H04R 1/30
2018/0115131 A1* 4/2018 Kohen ..... H01R 13/7038
2019/0219280 A1* 7/2019 Chitrala ..... F24F 13/24

FOREIGN PATENT DOCUMENTS

WO 9506925 A1 3/1995
WO 9711444 A1 3/1997

* cited by examiner window/door glass break-
alarm notification sent to the user

SYSTEM AND METHOD FOR SURVEILLANCE

This application claims the benefit of European Application No. 18174176.0, filed on May 24, 2018, which application is hereby incorporated herein by reference in its entirety.

TECHNICAL FIELD

The present invention relates to a system and a method for surveillance, and, in particular, for a system and a method for surveillance support in smart assistant systems.

BACKGROUND

Systems that employ speech recognition, for example, Amazon® Alexa®, Google® Home®, Apple® Homeport®, Microsoft® Cortana® are well-known in the art. It would be appreciated, if smart speaker systems and similar systems would provide surveillance functionality for a room in which these systems used. Even though voice recognition systems may, e.g., comprise the necessary audio processing capabilities to detect audio events resulting from, for example, burglary actions, audio processing alone may not be sufficient to make conclusive decision on whether, for example, a burglary is about to occur.

Different algorithms to detect a specific audio event. Algorithms that detect a specific audio event may e.g., be used to detect a glass break or a gun shot. These algorithms may predict an event, such as a glass break, with different accuracy. However, these algorithms cannot differentiate between burglaries and accident. For example, these algorithms cannot differentiate between a break of a window during a burglary and an accident, where a glass table or a drinking glass is broken. Instead, these algorithms simply may detect that glass is broken.

Thus, according to one solution, acoustic sensing with microphones is conducted. Conducting such audio processing for the detection of a burglary would, however, be unreliable due to the unreliable recognition of various glass break audio patterns. As a result, a plurality of false alarms would be triggered, as a differentiation between the different glass break situations would not be possible (a table glass break caused by an accident and a window glass break caused by a burglary would be interpreted in the same way), or no alarm at all would be triggered.

Another solution would be to attach sensors directly to each window that shall be protected against a burglary. A special infrastructure would be needed which would result in high costs.

Regarding the sensing of gunshots, no technical solution available today for indoors in private homes. Someone must hear the shot and call the police.

SUMMARY

A system for surveillance is provided in accordance with an embodiment. The system includes an audio signal analyzer, wherein the audio signal analyzer is configured to receive one or more audio microphone signals, wherein the audio signal analyzer is configured to determine a pattern matching result by determining whether the one or more microphone signals comprise at least one audio pattern of one or more predefined audio patterns. Moreover, the system comprises an air pressure change determiner, wherein the air pressure change determiner is configured to receive an air pressure change signal indicating an air pressure change; or wherein the air pressure change determiner is configured to receive an air pressure signal indicating a current air pressure and is configured to determine the air pressure change from the signal indicating the current air pressure and from a previously received air pressure. Furthermore, the system comprises an evaluator, wherein the evaluator is configured to indicate, depending on the pattern matching result and depending on the air pressure change that a predefined event occurred.

In accordance with an embodiment, a method includes receiving one or more audio microphone signals; determining a pattern matching result by determining whether the one or more microphone signals comprise at least one audio pattern of one or more predefined audio patterns; receiving an air pressure change signal indicating an air pressure change; or receiving an air pressure signal indicating a current air pressure and determining the air pressure change from the air pressure signal indicating the current air pressure and from a previously received air pressure, and indicating, depending on the pattern matching result and depending on the air pressure change that a predefined event occurred.

In accordance with a further embodiment, a computer program is configured to implement the above-described method when being executed on a computer or signal processor.

BRIEF DESCRIPTION OF THE DRAWINGS

In the following, embodiments of the present invention are described in more detail with reference to the figures, in which.

DETAILED DESCRIPTION OF ILLUSTRATIVE EMBODIMENTS

Figure 1:
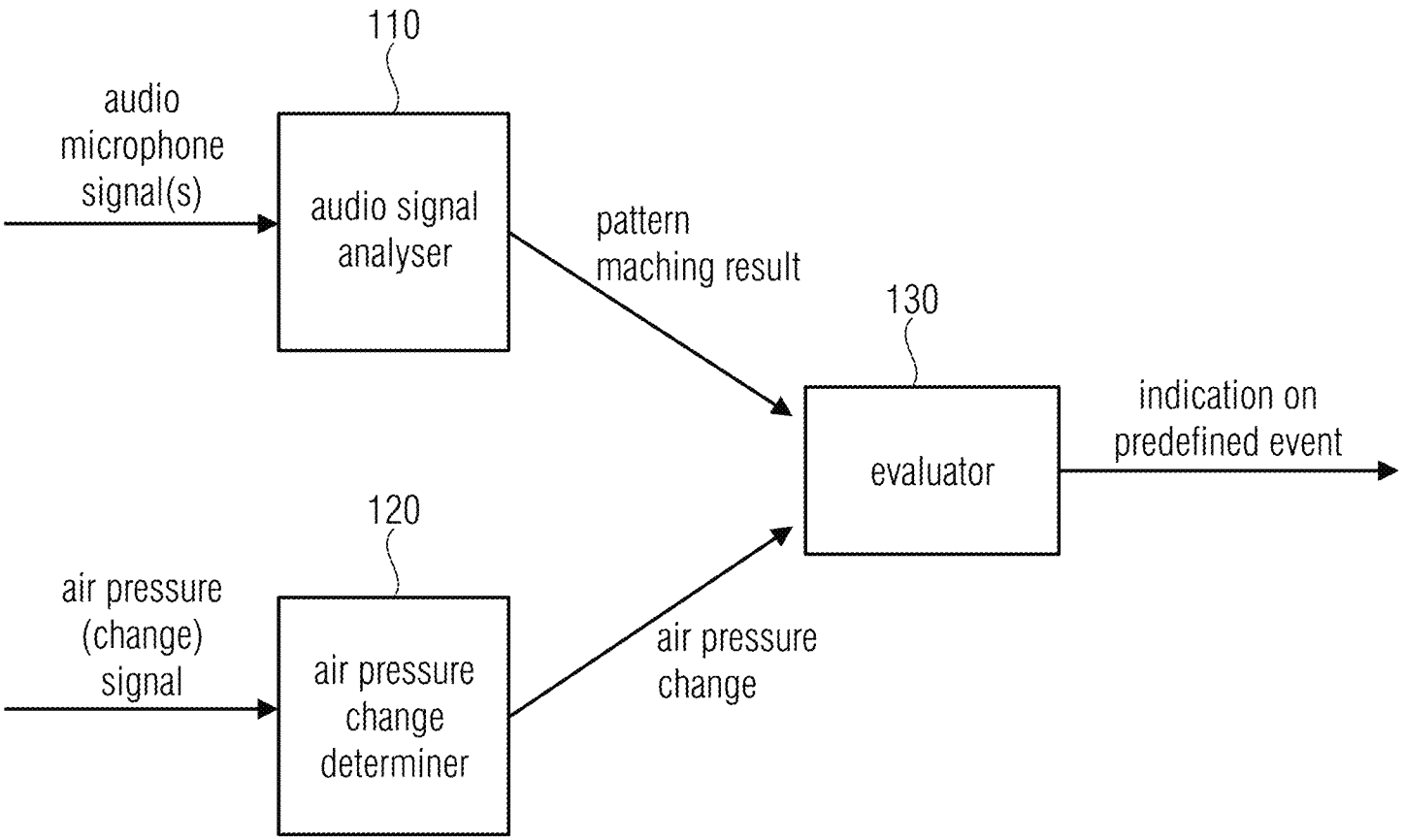
FIG. 1 illustrates a system for surveillance according to an embodiment.

FIG. 1 illustrates a system for surveillance according to an embodiment.

The system comprises an audio signal analyzer no, wherein the audio signal analyzer no is configured to receive one or more audio microphone signals, wherein the audio signal analyzer no is configured to determine a pattern matching result by determining whether the one or more microphone signals comprise at least one audio pattern of one or more predefined audio patterns.

Moreover, the system comprises an air pressure change determiner 120, wherein the air pressure change determiner 120 is configured to receive an air pressure change signal indicating an air pressure change; or wherein the air pressure change determiner 120 is configured to receive an air pressure signal indicating a current air pressure and is configured to determine the air pressure change from the signal indicating the current air pressure and from a previously received air pressure.

Furthermore, the system comprises an evaluator 130, wherein the evaluator 130 is configured to indicate, depending on the pattern matching result and depending on the air pressure change that a predefined event occurred.

The predefined event may, for example, be that the evaluator 130 assesses that a burglary takes place.

Or, the predefined event may, e.g., be defined more specific. The predefined event may, e.g., be that the evaluator 130 detects a window break, or may, e.g., be that the evaluator 130 detects a gun shot.

Some embodiments combine a low failure rate that can today only be reached by physical attachment of a sensor to each window, with a flexibility of a microphone-only system that works from distance, but lacks reliability.

In particular, some embodiments provide a significant reduction of false alarms compared to a microphone only solution. In some embodiments, an alarm may, e.g., be raised only when a detected audio profile matches a signature, and if there is at same time a characteristic pressure pulse, e.g., as a consequence from inflowing/outflowing air.

Some embodiments exhibit the advantage of a simple installation. In such embodiments, no new infrastructure may, e.g., be needed, as one, for example, battery driven "device", may, e.g., be placeable almost anywhere in a room can cover all windows in a room.

In embodiments, a pressure sensor pattern in combination with an acoustical glass break pattern may, e.g., provide a very reliable way to detect that a window was broken to enter a house in an unauthorized way.

In addition to the surveillance mode, in some embodiments, the smart assistant device may, e.g., be configured to also detect other acoustic events, for example, a gunshot.

In embodiments, the audio signal analyzer no may e.g., employ pattern matching concepts/pattern recognition concepts, in particular, e.g., pattern matching algorithms/pattern recognition algorithms.

According to an embodiment, the air pressure change determiner 120 may, e.g., be configured to receive the air pressure change signal indicating the air pressure change being a barometric air pressure change; or wherein the air pressure change determiner 120 may, e.g., be configured to receive the air pressure signal indicating the current air pressure being a current barometric air pressure and is configured to determine the air pressure change being the barometric air pressure change from the signal indicating the current barometric air pressure and from a previously received barometric air pressure being the previously received air pressure change. In such an embodiment, the evaluator 130 may, e.g., be configured to indicate, depending on the pattern matching result and depending on the barometric air pressure change that the predefined event occurred.

Barometric air pressure, sometimes referred to as barometric pressure or sometimes referred to as atmospheric pressure, may, e.g., be defined to be the pressure within the atmosphere of Earth. In most circumstances, atmospheric pressure may, e.g., be closely approximated by the hydrostatic pressure caused by the weight of air above the measurement point.

Some embodiments may, e.g., use a high resolution pressure sensor chip in combination with acoustic algorithms to detect a glass break to have a safe interpretation of a burglary action.

A high resolution pressure sensor, for example, Infineon®'s DPS310, may, e.g., be employed to detect door openings and window openings with the characteristic dynamic barometric pressure change that these events trigger.

Thus, e.g., a high resolution pressure sensor, for example, Infineon®'s DPS310, may, e.g., be employed to detect door openings and window openings with the characteristic dynamic barometric pressure change.

The DPS310 is a miniaturized Digital Barometric Air Pressure Sensor with a high accuracy level and low current consumption. The DPS310 comprises a pressure sensor element, which is based on a capacitive principle which guarantees high precision during temperature changes. The small package makes the DPS310 ideal for mobile applications and wearable devices.

The DPS310's internal signal processor converts the output from the pressure sensor elements to a 24-bit result. Each pressure sensor has been calibrated individually and contains calibration coefficients. The coefficients are used in the application to convert the measurement results to true pressure values.

The DPS310 sensor has a FIFO that can store the latest 32 measurements. Since the host processor can remain in a sleep mode for a longer period between readouts, a FIFO can reduce the system power consumption.

In the DPS310 sensor, sensor measurements and calibration coefficients are available via the serial I2C/SPI interface.

In an embodiment, the evaluator 130 may, e.g., be configured to indicate that the predefined event occurred depending on the pattern matching result and depending on whether the air pressure change is greater than a threshold value.

The threshold value may, e.g., make sure that insignificant air pressure changes do not lead to a false alarm. Air pressure changes may, e.g., only be considered, if an air pressure change value that indicates the air pressure change is greater than the threshold value.

According to an embodiment, the audio signal analyzer 110 may, e.g., be configured to determine the pattern matching result such that the pattern matching result indicates that one of the one or more predefined audio patterns is found, if at least one of the one or more audio microphone signals comprises said one of one or more predefined audio patterns. In such an embodiment, the evaluator 130 may, e.g., be configured to indicate that the predefined event occurred depending on the air pressure change and depending on whether the pattern matching result indicates that said one of the one or more predefined audio patterns is found.

In an embodiment, the audio signal analyzer 110 may, e.g., be configured to determine the pattern matching result such that the pattern matching result indicates that one of the one or more predefined audio patterns is found, if at least one of the one or more audio microphone signals comprises said one of one or more predefined audio patterns. In such an embodiment, the evaluator 130 may, e.g., be configured to indicate that the predefined event occurred, if the pattern matching result indicates that said one of the one or more predefined audio patterns is found in said at least one of the one or more audio microphone signals and if the air pressure change is greater than a threshold value.

In an embodiment, the audio signal analyzer 110 may, e.g., be configured to determine the pattern matching result such that the pattern matching result indicates that a predefined audio pattern of the one or more predefined audio patterns is found, if an audio microphone signal of the one or more audio microphone signals comprises said predefined audio pattern of the one or more predefined audio patterns. In such an embodiment, if the pattern matching result indicates that said predefined audio pattern of the one or more predefined audio patterns is found and if the air pressure change is greater than a threshold value, the evaluator 130 may, e.g., be configured to indicate that the predefined event occurred, if said predefined audio pattern occurred at a same time in said audio microphone signal as said air pressure change, being greater than said threshold value, occurred in the air pressure change signal. By this, certainty is increased that the same root event (e.g. a window glass break) has caused both events, if it is determined that the pressure change and the audio event pattern happen at exactly the same time.

According to an embodiment, the audio signal analyzer 110 may, e.g., be configured to receive two or more audio microphone signals as the one or more audio microphone signals. In such an embodiment, the audio signal analyzer 110 may, e.g., be configured to determine the pattern matching result by determining whether each one of the two or more audio microphone signals comprises said at least one audio pattern of one or more predefined audio patterns. Moreover, in such an embodiment, the evaluator 130 may, e.g., be configured to indicate that the predefined event occurred, if the pattern matching result indicates that said one of the one or more predefined audio patterns is found in each of the two or more audio microphone signals, and if the air pressure change is greater than a threshold value.

Moreover, in some embodiments, the smart assistant device may, e.g., be configured to actively trigger alarm calls.

Figure 2:
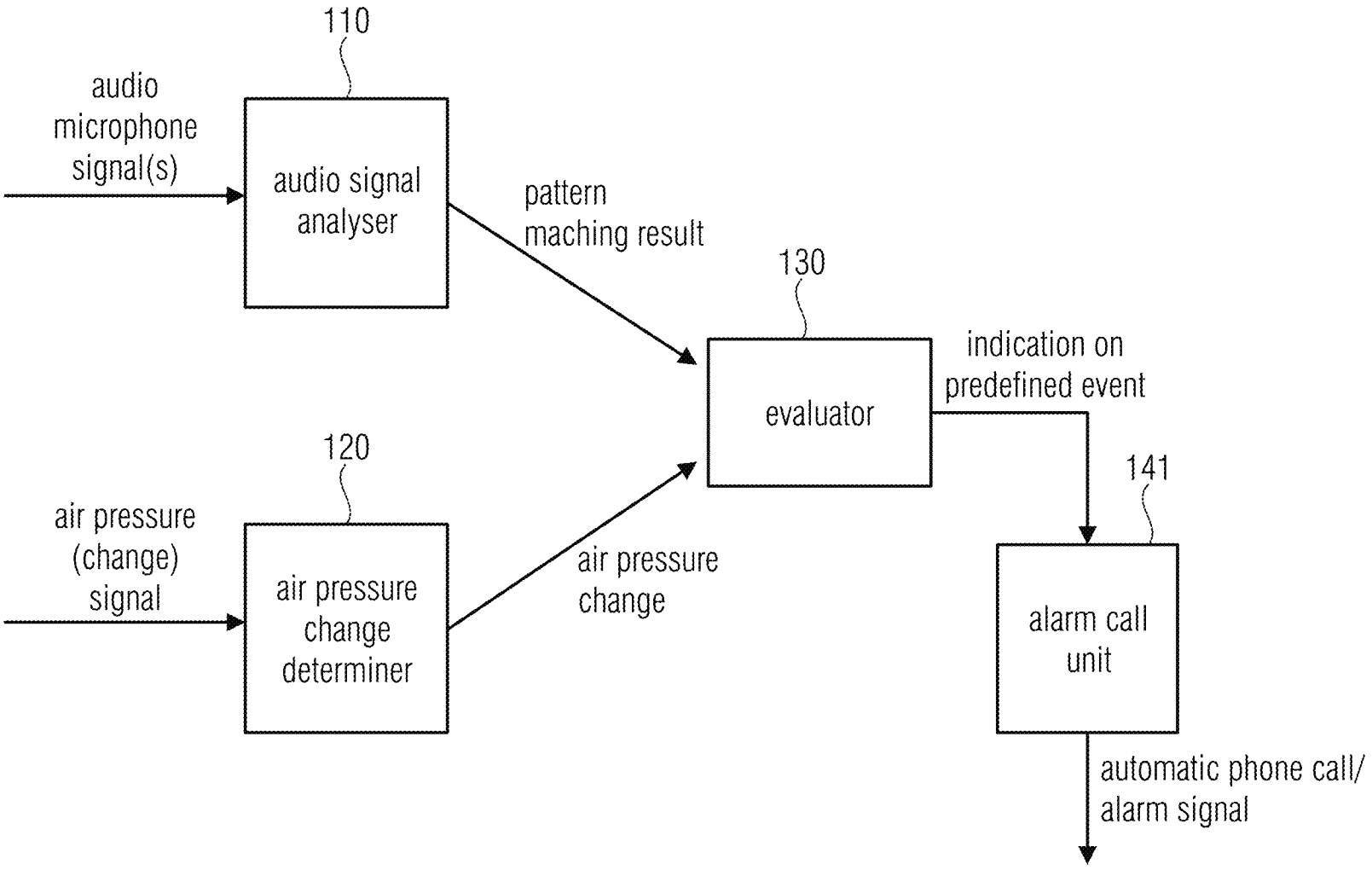
FIG. 2 illustrates a system for surveillance according to another embodiment, wherein the system further comprises an alarm call unit.

For example, in an embodiment illustrated by FIG. 2, the system further comprises an alarm call unit 141. In such an embodiment, if the evaluator 130 indicates that the predefined event occurred, the alarm call unit 141 may, e.g., be configured to conduct an automatic phone call, said automatic phone call by which the alarm call unit 141 informs a recipient of the automatic phone call that the predefined event occurred. Or, if the evaluator 130 indicates that the predefined event occurred, the alarm call unit 141 may, e.g., be configured to send an alarm signal using wired communications or wireless communications, said alarm signal informing the recipient of the automatic phone call that the predefined event occurred.

Figure 3:
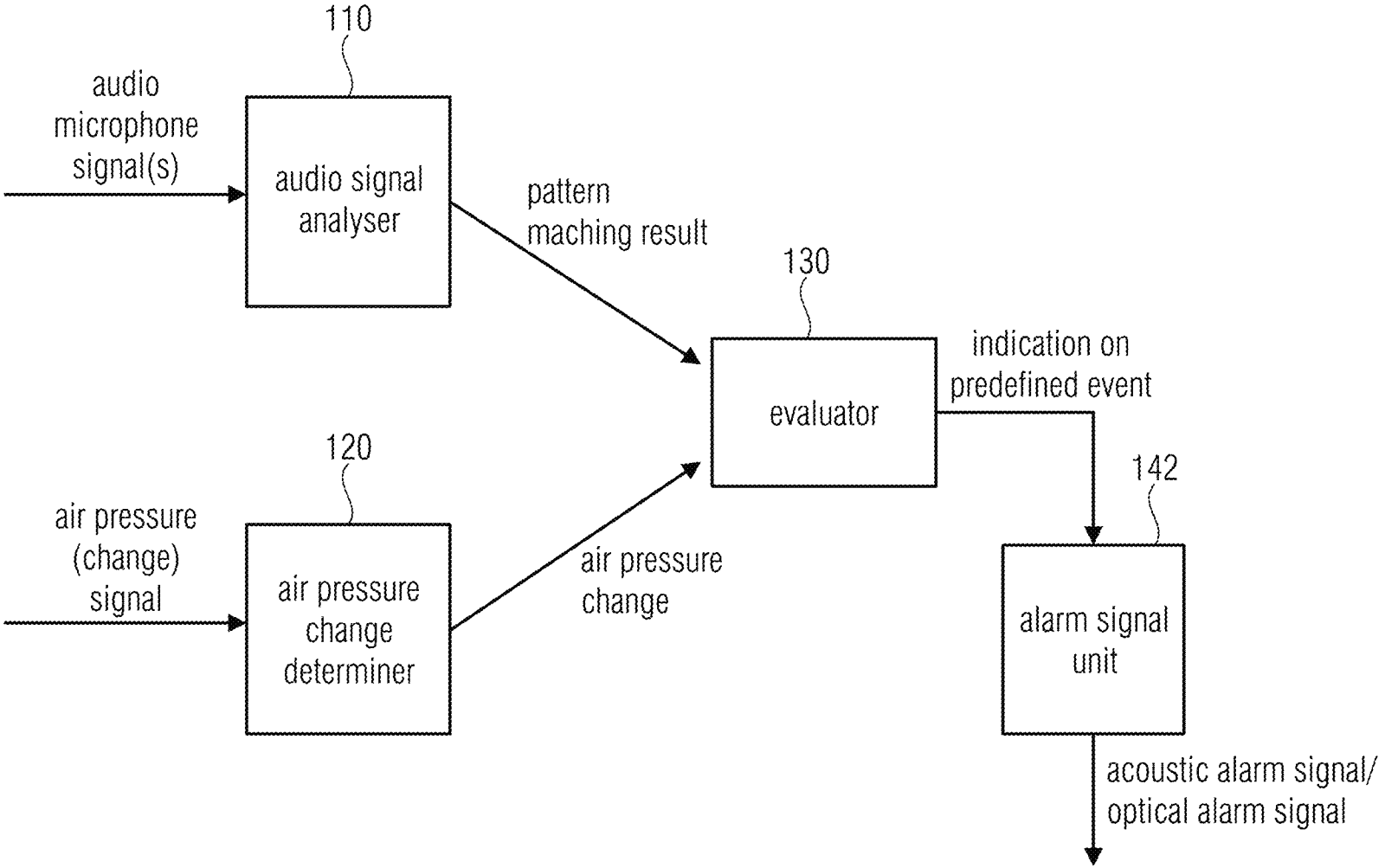
FIG. 3 illustrates a system for surveillance according to a further embodiment, wherein the system further comprises an alarm signal unit.

According to an embodiment illustrated by FIG. 3, the system may, e.g., further comprise an alarm signal unit 142. In such an embodiment, if the evaluator 130 indicates that the predefined event occurred, the alarm signal unit 142 may, e.g., be configured to output at least one of an acoustic alarm signal and an optical alarm signal.

An acoustic alarm signal may, e.g., be a siren sound.

An optical alarm signal may, e.g., be a flashing light.

In an embodiment, the audio signal analyzer 110 and the air pressure change determiner 120 and the evaluator 130 may, e.g., be wirelessly connected.

So, in some embodiments, the device, e.g., (for example, high resolution) pressure sensor may, e.g., be wirelessly connected to the smart assistant.

According to another embodiment, the audio signal analyzer 110 and the air pressure change determiner 120 and the evaluator 130 may, e.g., be integrated into one device.

In some embodiments, the device 120, e.g., the (for example, high resolution) pressure sensor may, e.g., be implemented into the smart assistant.

Figure 4:
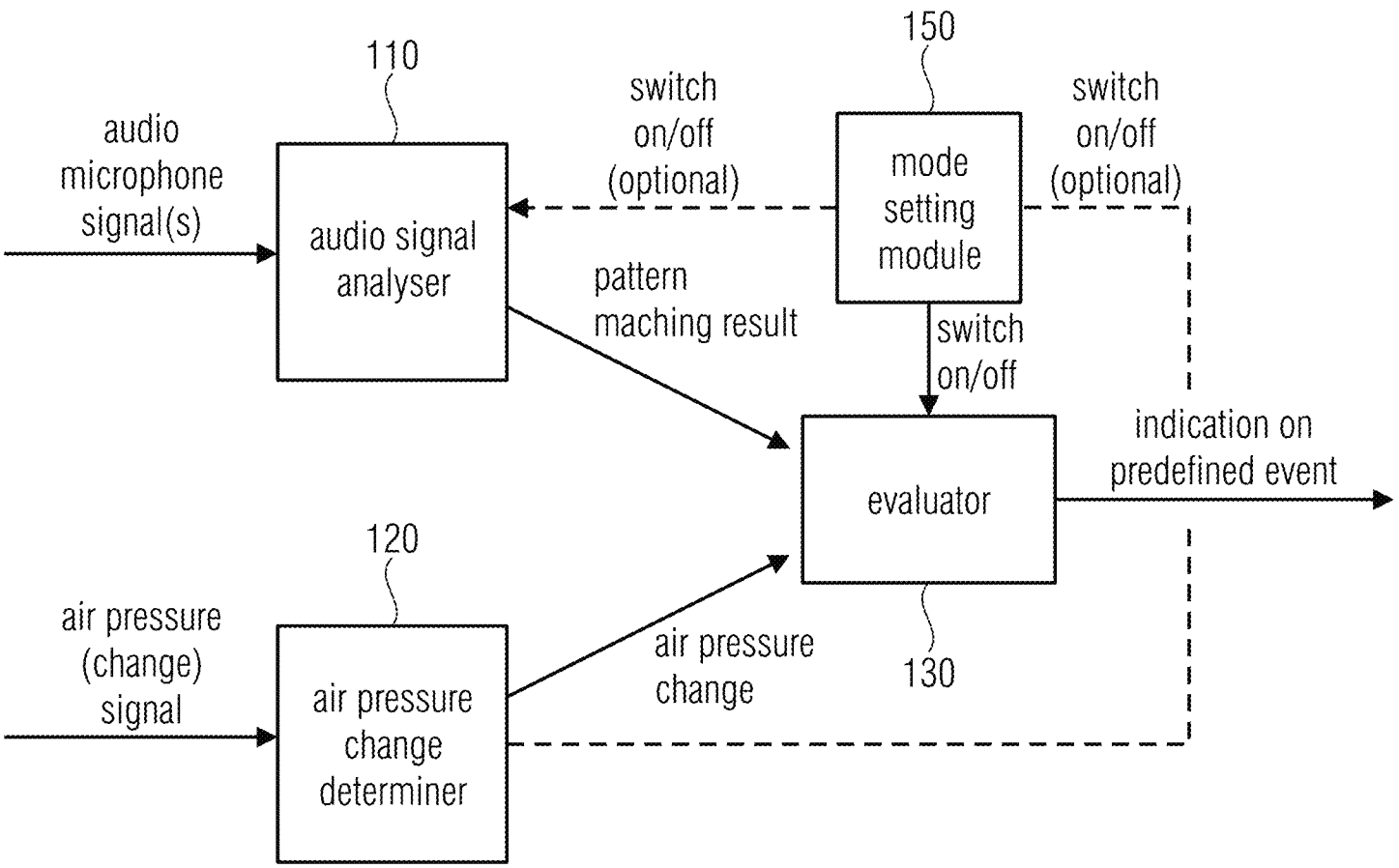
FIG. 4 illustrates a system for surveillance according to another embodiment, wherein the system further comprises a mode setting module.

In an embodiment illustrated by FIG. 4, the system may, e.g., further comprise a mode setting module 150, being configured to set the system into a first mode, in which surveillance is active, and into a different, second more, in which surveillance is not active. In such an embodiment, if the system is in the first mode, the evaluator 130 may, e.g., be configured to indicate, depending on the pattern matching result and depending on the air pressure change that the predefined event occurred. Moreover, in such an embodiment, if the system is in the second mode, the evaluator 130 may, e.g., be configured to not indicate that the predefined event occurred, irrespective of the pattern matching result and irrespective of the air pressure change that a predefined event occurred.

A smart assistant system may, for example, be set in a defined mode (for example, in a first mode in which surveillance is active, compared to a different, second mode, in which, for example, surveillance is not active) to ensure that the smart assistant system is not triggering a false alarm in case of an accident (e.g. a football that breaks a window, is not triggering a false alarm, if the smart assistant system has been set in a mode, where surveillance is not active).

Figure 5:
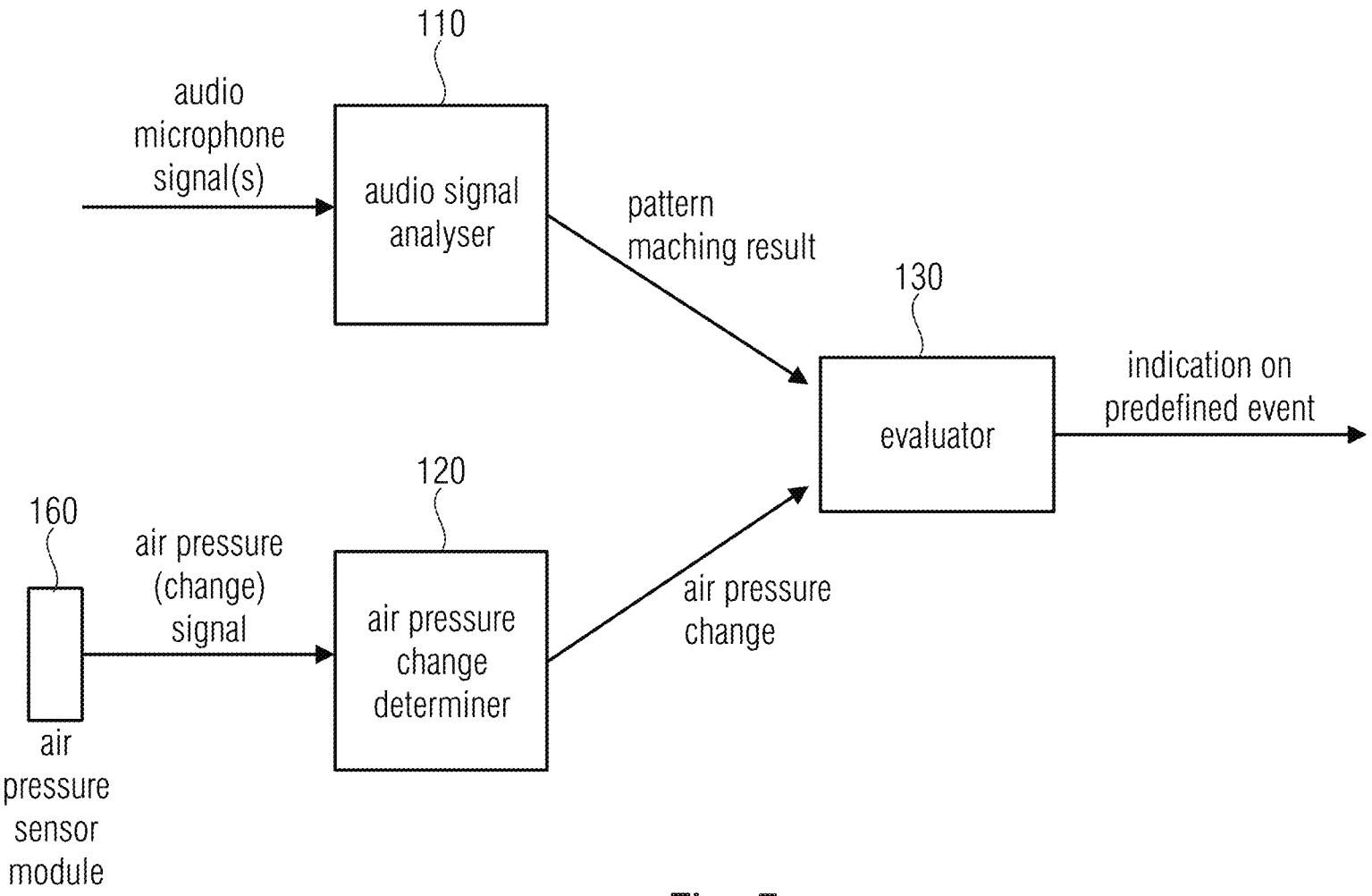
FIG. 5 illustrates a system for surveillance according to a further embodiment, wherein the system further comprises an air pressure sensor module.

According to an embodiment illustrated by FIG. 5, the system may, e.g., comprise an air pressure sensor module 160, wherein the air pressure sensor module 160 may, e.g., be configured to measure a current air pressure to generate the air pressure signal; or wherein the air pressure sensor module 160 may, e.g., be configured to generate the air pressure change signal by measuring the current air pressure and by determining the air pressure change from the current air pressure and from a previous air pressure.

Such an air pressure sensor module 160 may, e.g., be Infineon®'s DPS310.

Figure 6:
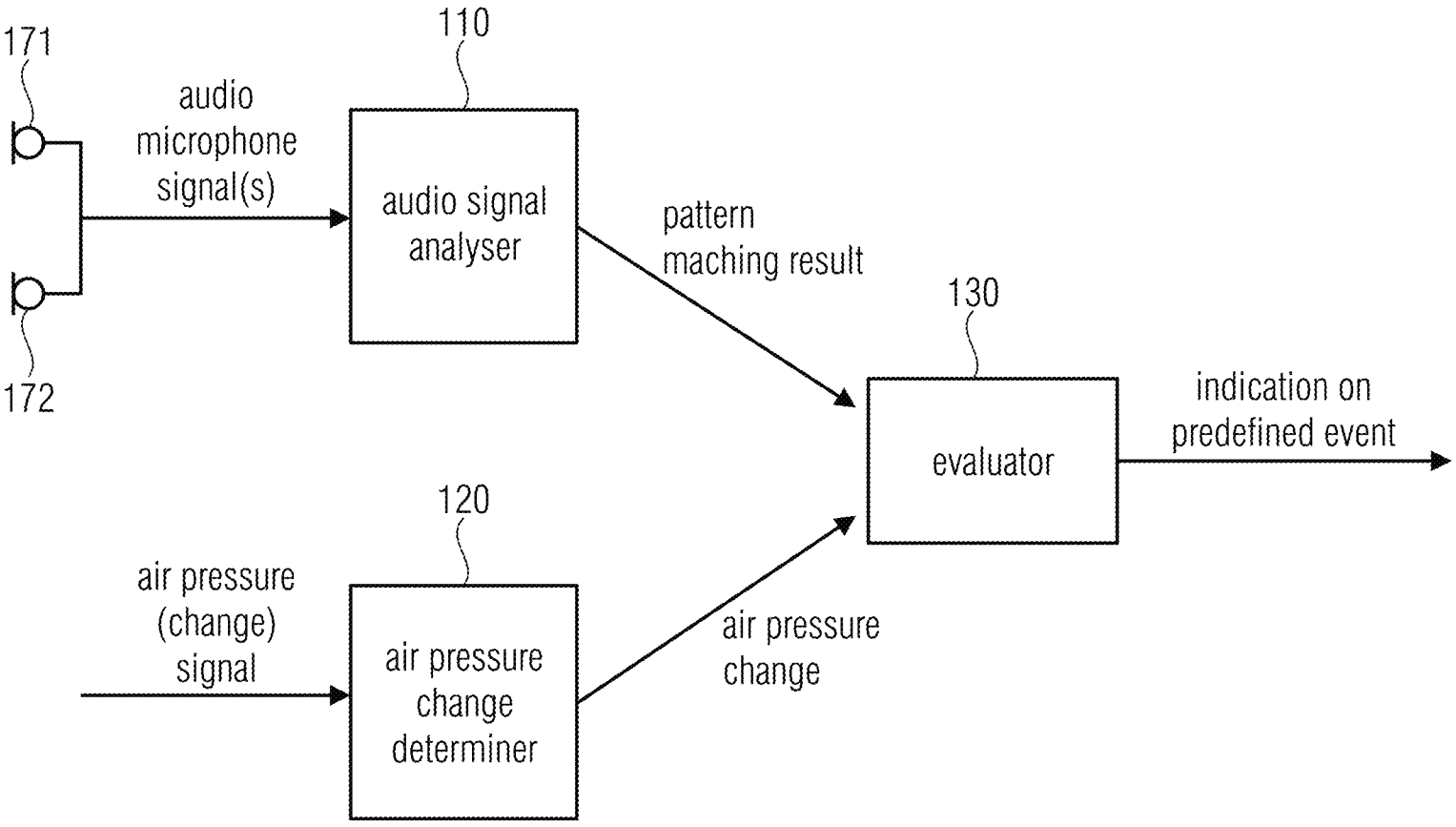
FIG. 6 illustrates a system for surveillance according to a further embodiment, wherein the system further comprises an air pressure sensor module.

In an embodiment illustrated by FIG. 6, the system may, e.g., comprise one or more microphones 171, 172; wherein the one or more microphones 171, 172 may, e.g., be configured to record the one or more audio microphone signals.

In the following, particular embodiments are provided.

Figure 7:
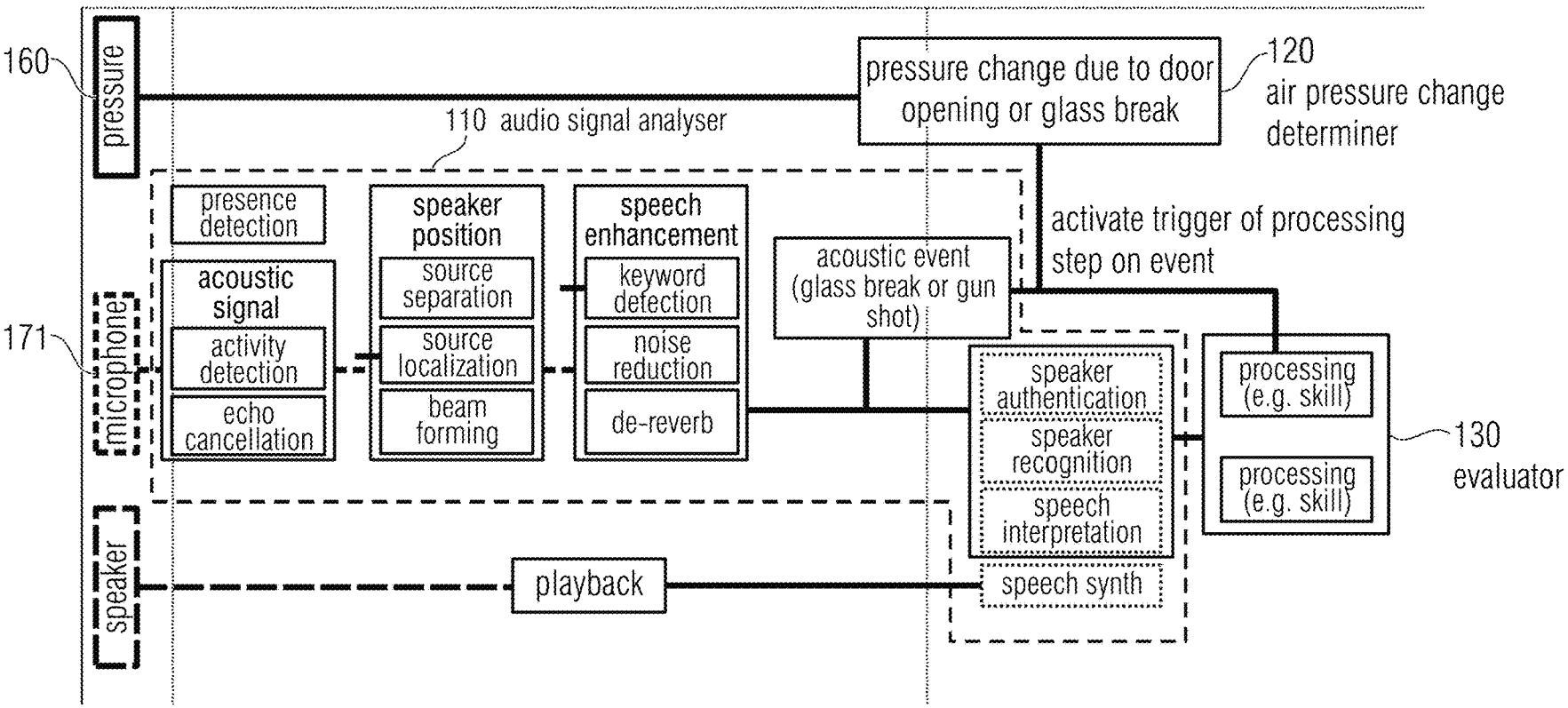
FIG. 7 illustrates a system level diagram of a smart speaker system using a pressure sensor for surveillance support according to an embodiment.

FIG. 7 illustrates a system level diagram of a smart speaker system using a pressure sensor for surveillance support according to an embodiment.

In particular, FIG. 7 shows a system level diagram of a smart speaker system having an additional high accuracy pressure sensor readout path in combination with the conventional audio path. In the pressure sensor path, digital signal processing is used to detect barometric air pressure changes resulting from opening a door or a window.

The second path is the audio path with 1 to n microphones. Conventional audio processing used in conventional one or more smart speaker systems. FIG. 7 an additional building block (e.g., a unit) for detecting a specified acoustic event (like glass break or gunshot).

In particular, FIG. 7 illustrates an additional logic that triggers actively a processing loop (e.g., skill) in case a pressure event indicates a change in air pressure and at the same time the acoustic event trigger detects a glass break.

This logic can be activated with a specific alarm mode that the user can activate as soon as he leaves the room or house.

The combination of pressure sensor data with acoustic data provides a safe indication of a burglary event that will result in an appropriate action (e.g. alarm call).

Embodiments may be used in all smart speaker, smart assistance systems that are today in the market (including smart TVs) if an additional pressure sensor is added/linked to the system.

Some embodiments are configured to use a pressure sensor event detection together with an audio event detection to conclude on a glass break that results from burglary actions.

Figure 8A:
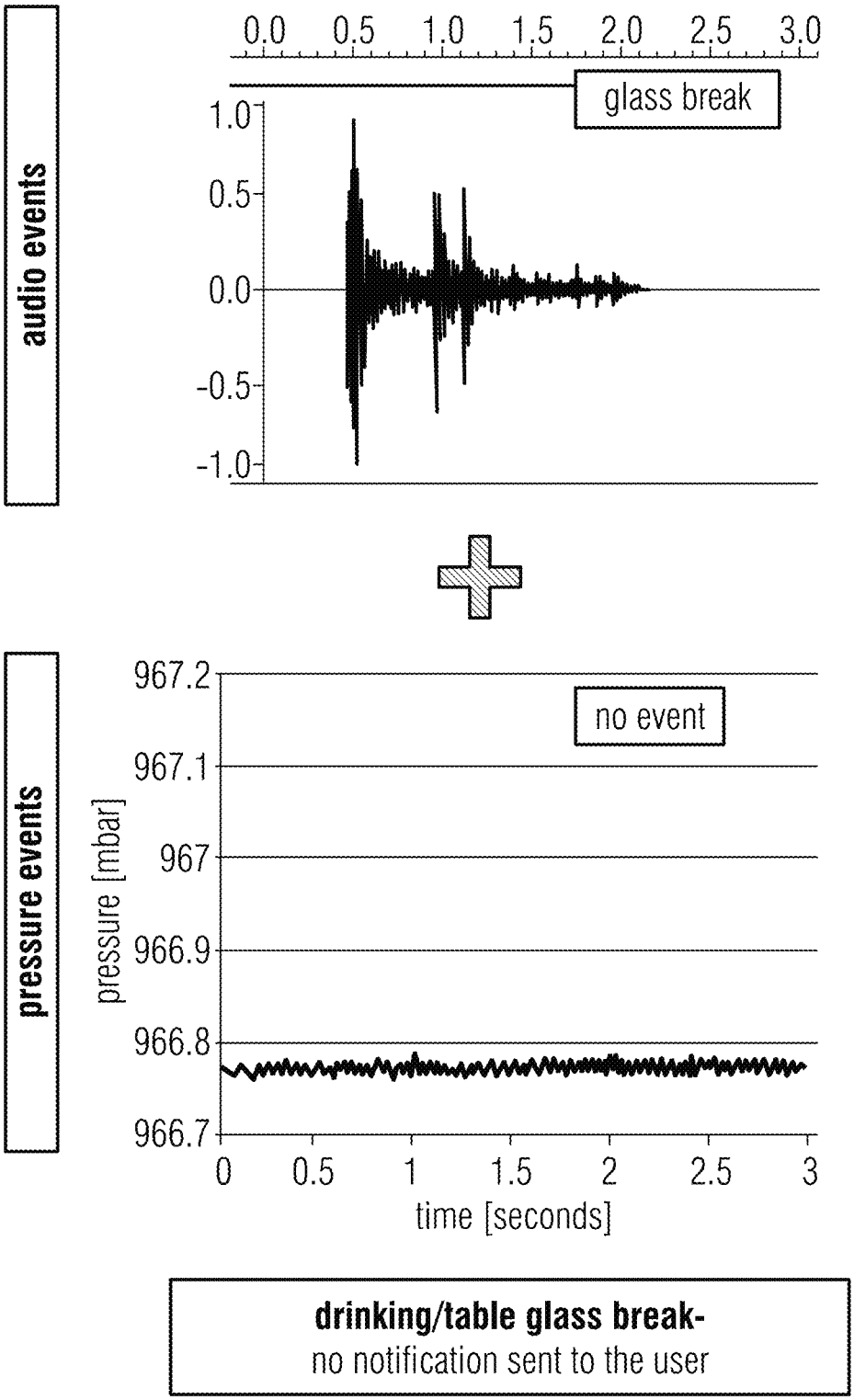
FIGS. 8A-8C illustrate automatic categorization versus user categorization according to an embodiment.
Figure 8B:
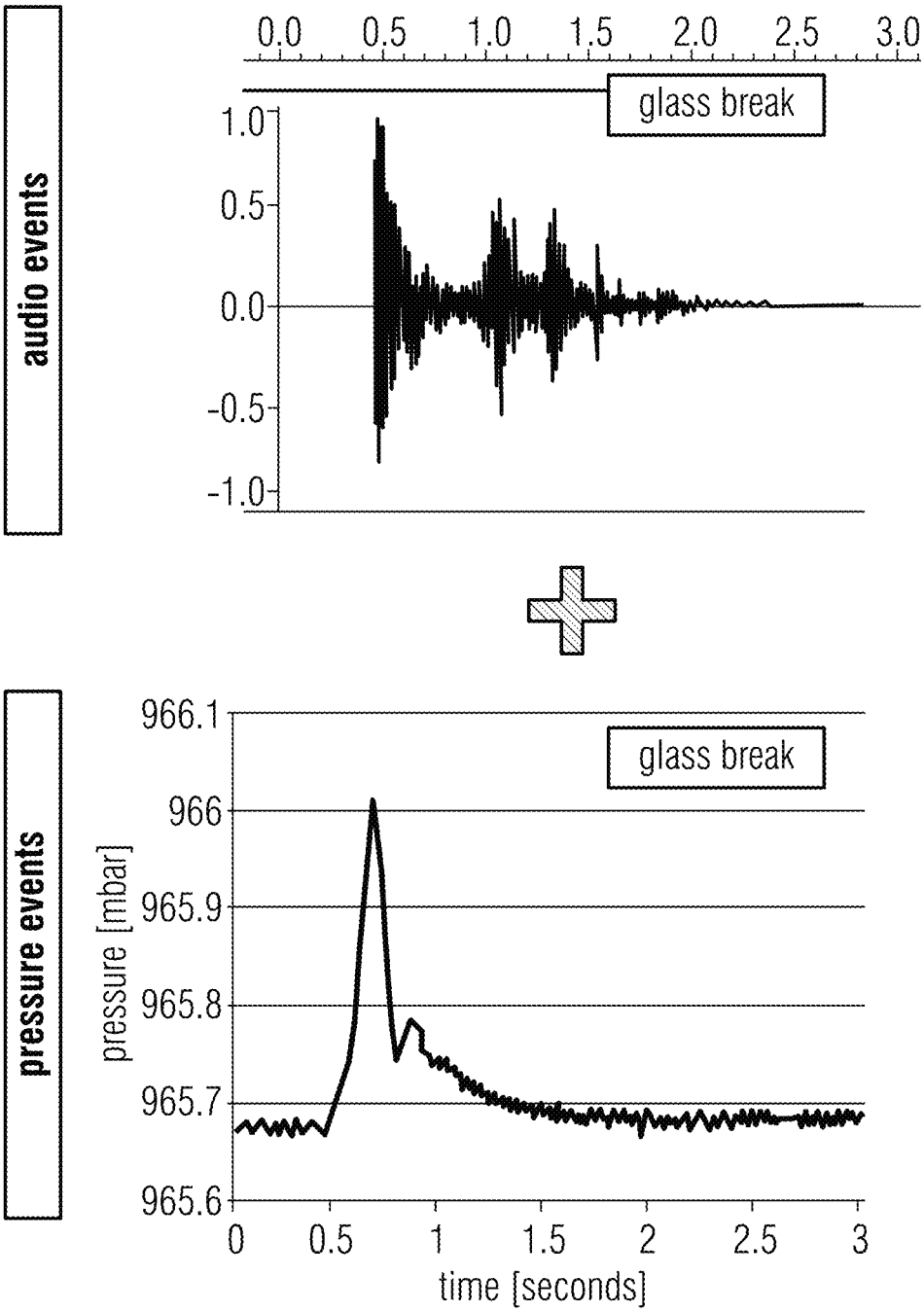
Figure 8C:
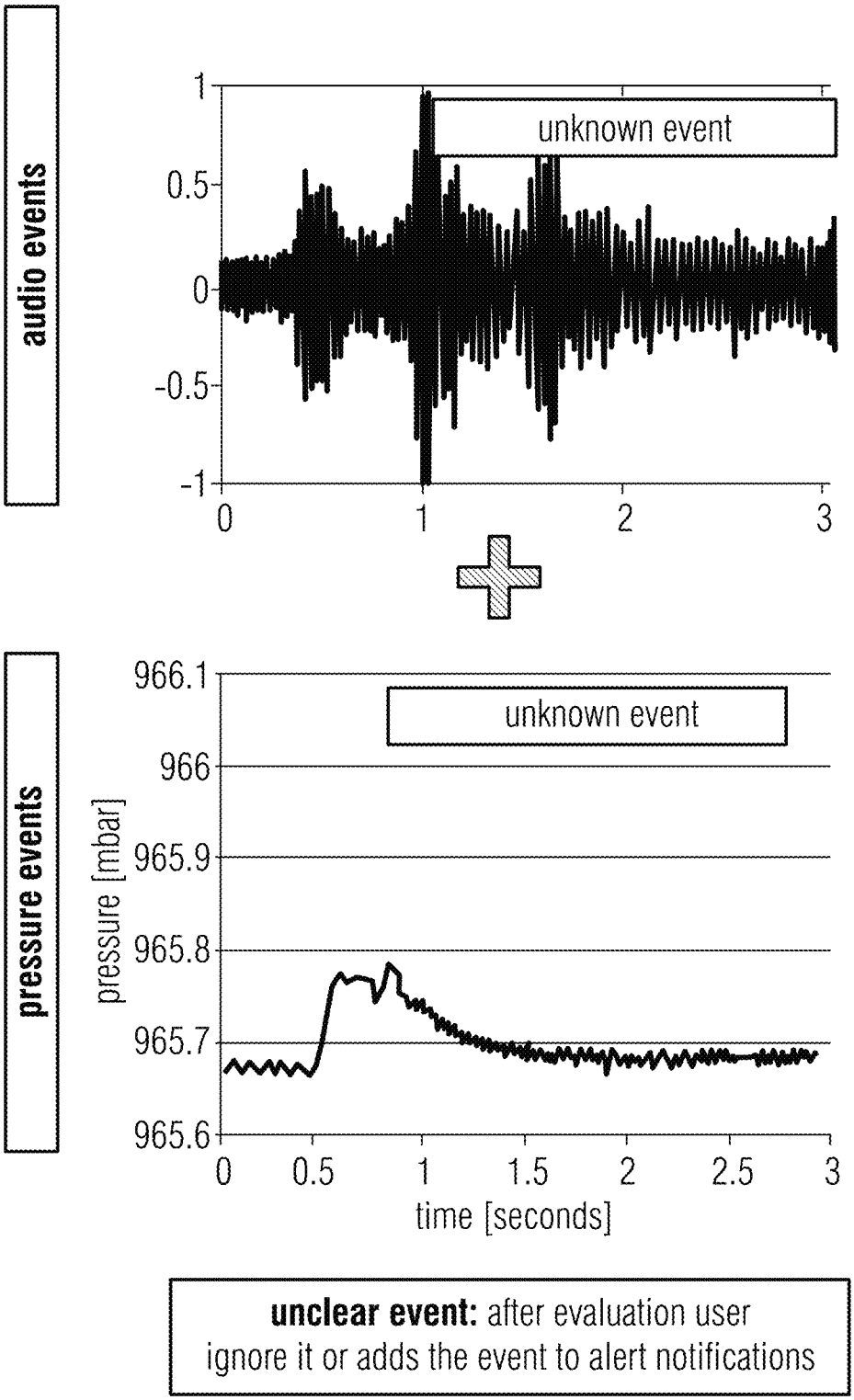

FIG. 8 illustrates automatic categorization versus user categorization according to an embodiment. In the embodiment of FIG. 8, three scenarios, namely scenario (a), scenario (b) and scenario (c) are illustrated.

In scenario (a), an acoustic audio event is detected by the system, but no pressure event is detected by the system. In such a scenario, in the embodiment of FIG. 8, the system sends no notification to a user, because it can be concluded that the acoustic audio event was likely created by a drinking glass break or a table glass break, because no pressure event occurred.

In scenario (b), an acoustic audio event is detected by the system, and, at the same time, a pressure event is detected by the system. In such a scenario, in the embodiment of FIG. 8, the system sends an alarm notification to the user, because it can be concluded that the acoustic audio event and the pressure event were likely created by a window glass break or door glass break, because, in addition to the acoustic audio event, the pressure event occurred.

In scenario (c), an acoustic audio event is detected by the system, and an unspecific deviation in the pressure signal is detected by the system, wherein the unspecific deviation in the pressure signal did not start at exactly the same time as the acoustic audio event. In such a scenario, in the embodiment of FIG. 8, the system sends an "unclear event" notification to the user, and the user may, e.g., evaluate the information from the system. After evaluation, the user may, e.g., ignore the "unclear event" notification or may, e.g., add the "unclear event" notification to (e.g., a list of) alert notifications.

In the following, particular embodiments are provided.

A system for surveillance according to an embodiment is provided.

The system comprises an audio signal analyzer 110, wherein the audio signal analyzer 110 is configured to receive one or more audio microphone signals, wherein the audio signal analyzer 110 is configured to determine a pattern matching result by determining whether the one or more microphone signals comprise at least one audio pattern of one or more predefined audio patterns.

Moreover, the system comprises an air pressure change determiner 120, wherein the air pressure change determiner 120 is configured to receive an air pressure change signal indicating an air pressure change; or wherein the air pressure change determiner 120 is configured to receive an air pressure signal indicating a current air pressure and is configured to determine the air pressure change from the signal indicating the current air pressure and from a previously received air pressure.

Furthermore, the system comprises an evaluator 130, wherein the evaluator 130 is configured to indicate, depending on the pattern matching result and depending on the air pressure change that a predefined event occurred.

According to an embodiment, the air pressure change determiner 120 may, e.g., be configured to receive the air pressure change signal indicating the air pressure change being a barometric air pressure change; or wherein the air pressure change determiner 120 may, e.g., be configured to receive the air pressure signal indicating the current air pressure being a current barometric air pressure and is configured to determine the air pressure change being the barometric air pressure change from the signal indicating the current barometric air pressure and from a previously received barometric air pressure being the previously received air pressure change. In such an embodiment, the evaluator 130 may, e.g., be configured to indicate, depending on the pattern matching result and depending on the barometric air pressure change that the predefined event occurred.

In an embodiment, the evaluator 130 may, e.g., be configured to indicate that the predefined event occurred depending on the pattern matching result and depending on whether the air pressure change is greater than a threshold value.

According to an embodiment, the audio signal analyzer 110 may, e.g., be configured to determine the pattern matching result such that the pattern matching result indicates that one of the one or more predefined audio patterns is found, if at least one of the one or more audio microphone signals comprises said one of one or more predefined audio patterns. In such an embodiment, the evaluator 130 may, e.g., be configured to indicate that the predefined event occurred depending on the air pressure change and depending on whether the pattern matching result indicates that said one of the one or more predefined audio patterns is found.

In an embodiment, the audio signal analyzer 110 may, e.g., be configured to determine the pattern matching result such that the pattern matching result indicates that one of the one or more predefined audio patterns is found, if at least one of the one or more audio microphone signals comprises said one of one or more predefined audio patterns. In such an embodiment, the evaluator 130 may, e.g., be configured to indicate that the predefined event occurred, if the pattern matching result indicates that said one of the one or more predefined audio patterns is found in said at least one of the one or more audio microphone signals and if the air pressure change is greater than a threshold value.

According to an embodiment, the audio signal analyzer 110 may, e.g., be configured to receive two or more audio microphone signals as the one or more audio microphone signals. In such an embodiment, the audio signal analyzer 110 may, e.g., be configured to determine the pattern matching result by determining whether each one of the two or more audio microphone signals comprises said at least one audio pattern of one or more predefined audio patterns. Moreover, in such an embodiment, the evaluator 130 may, e.g., be configured to indicate that the predefined event occurred, if the pattern matching result indicates that said one of the one or more predefined audio patterns is found in each of the two or more audio microphone signals, and if the air pressure change is greater than a threshold value.

In an embodiment, the system further comprises an alarm call unit 141. In such an embodiment, if the evaluator 130 indicates that the predefined event occurred, the alarm call unit 141 may, e.g., be configured to conduct an automatic phone call, said automatic phone call by which the alarm call unit 141 informs a recipient of the automatic phone call that the predefined event occurred. Or, if the evaluator 130 indicates that the predefined event occurred, the alarm call unit 141 may, e.g., be configured to send an alarm signal using wired communications or wireless communications, said alarm signal informing the recipient of the automatic phone call that the predefined event occurred.

According to an embodiment, the system may, e.g., further comprise an alarm signal unit 142. In such an embodiment, if the evaluator 130 indicates that the predefined event occurred, the alarm signal unit 142 may, e.g., be configured to output at least one of an acoustic alarm signal and an optical alarm signal.

In an embodiment, the audio signal analyzer 110 and the air pressure change determiner 120 and the evaluator 130 may, e.g., be wirelessly connected.

According to an embodiment, the audio signal analyzer 110 and the air pressure change determiner 120 and the evaluator 130 may, e.g., be integrated into one device.

In an embodiment, the system may, e.g., further comprise a mode setting module 150, being configured to set the system into a first mode, in which surveillance is active, and into a different, second more, in which surveillance is not active. In such an embodiment, if the system is in the first mode, the evaluator 130 may, e.g., be configured to indicate, depending on the pattern matching result and depending on the air pressure change that the predefined event occurred. Moreover, in such an embodiment, if the system is in the second mode, the evaluator 130 may, e.g., be configured to not indicate that the predefined event occurred, irrespective of the pattern matching result and irrespective of the air pressure change that a predefined event occurred.

According to an embodiment, the system may, e.g., comprise an air pressure sensor module 160, wherein the air pressure sensor module 160 may, e.g., be configured to measure a current air pressure to generate the air pressure signal; or wherein the air pressure sensor module 160 may, e.g., be configured to generate the air pressure change signal by measuring the current air pressure and by determining the air pressure change from the current air pressure and from a previous air pressure.

In an embodiment, the system may, e.g., comprise one or more microphones 171, 172; wherein the one or more microphones 171, 172 may, e.g., be configured to record the one or more audio microphone signals.

Moreover, a method for surveillance is provided. The method comprises: Receiving one or more audio microphone signals. Determining a pattern matching result by determining whether the one or more microphone signals comprise at least one audio pattern of one or more predefined audio patterns. Receiving an air pressure change signal indicating an air pressure change. Or, receiving an air pressure signal indicating a current air pressure and determining the air pressure change from the air pressure signal indicating the current air pressure and from a previously received air pressure. And: Indicating, depending on the pattern matching result and depending on the air pressure change, that a predefined event occurred.

Moreover, a computer program is provided, wherein the computer program is configured to implement the above-described method when being executed on a computer or signal processor.

Although some aspects have been described in the context of a system or an apparatus, it is clear that these aspects also represent a description of the corresponding method, where a block or device corresponds to a method step or a feature of a method step. Analogously, aspects described in the context of a method step also represent a description of a corresponding block or item or feature of a corresponding system or a corresponding apparatus. Some or all of the method steps may be executed by (or using) a hardware apparatus, like for example, a microprocessor, a programmable computer or an electronic circuit. In some embodiments, one or more of the most important method steps may be executed by such an apparatus.

Depending on certain implementation requirements, embodiments of the invention can be implemented in hardware or in software or at least partially in hardware or at least partially in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitory.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are preferably performed by any hardware apparatus.

The system described herein may be implemented using a hardware apparatus, or using a computer, or using a combination of a hardware apparatus and a computer.

The methods described herein may be performed using a hardware apparatus, or using a computer, or using a combination of a hardware apparatus and a computer.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A system for surveillance, comprising:

an audio signal analyzer comprising a first sensor device, wherein the audio signal analyzer is configured to receive one or more audio microphone signals at a first input, wherein the audio signal analyzer is configured to determine a pattern matching result by determining whether the one or more audio microphone signals comprise at least one audio pattern of one or more predefined audio patterns;

an air pressure change determiner comprising a second sensor device different from the first sensor device, wherein the air pressure change determiner is configured to receive an air pressure change signal indicating an air pressure change at a second input distinct from the first input, and wherein the one or more audio microphone signals and the air pressure change signal comprise different signals respectively received by the first sensor device and the second sensor device; and an evaluator, wherein the evaluator is configured to indicate, depending on the pattern matching result and depending on the air pressure change, that a predefined event occurred, wherein the first sensor device comprises a microphone and the second sensor device comprises a barometric air pressure sensor.

2. The system according to claim 1, wherein the air pressure change determiner is configured to receive the air pressure change signal indicating the air pressure change being a barometric air pressure change; and wherein the evaluator is configured to indicate, depending on the pattern matching result and depending on the barometric air pressure change, that the predefined event occurred.

3. The system according to claim 1:

wherein the evaluator is configured to indicate that the predefined event occurred depending on the pattern matching result and depending on whether the air pressure change is greater than a threshold value.

4. The system according to claim 1:

wherein the audio signal analyzer is configured to determine the pattern matching result such that the pattern matching result indicates that one of the one or more predefined audio patterns is found, if at least one of the one or more audio microphone signals comprises said one of one or more predefined audio patterns; and wherein the evaluator is configured to indicate that the predefined event occurred depending on the air pressure change and depending on whether the pattern matching result indicates that said one of the one or more predefined audio patterns is found.

5. The system according to claim 1:

wherein the audio signal analyzer is configured to determine the pattern matching result such that the pattern matching result indicates that one of the one or more predefined audio patterns is found, if at least one of the one or more audio microphone signals comprises said one of one or more predefined audio patterns; and wherein the evaluator is configured to indicate that the predefined event occurred, if the pattern matching result indicates that said one of the one or more predefined audio patterns is found in said at least one of the one or more audio microphone signals and if the air pressure change is greater than a threshold value.

6. The system according to claim 1:

wherein the audio signal analyzer is configured to determine the pattern matching result such that the pattern matching result indicates that a predefined audio pattern of the one or more predefined audio patterns is found, if an audio microphone signal of the one or more audio microphone signals comprises said predefined audio pattern of the one or more predefined audio patterns; and wherein, if the pattern matching result indicates that said predefined audio pattern of the one or more predefined audio patterns is found and if the air pressure change is greater than a threshold value, the evaluator is configured to indicate that the predefined event occurred, if said predefined audio pattern occurred at a same time in said audio microphone signal as said air pressure change, being greater than said threshold value, occurred in the air pressure change signal.

7. The system according to claim 1:

wherein the audio signal analyzer is configured to receive two or more audio microphone signals as the one or more audio microphone signals, wherein the audio signal analyzer is configured to determine the pattern matching result by determining whether each one of the two or more audio microphone signals comprises said at least one audio pattern of one or more predefined audio patterns; and wherein the evaluator is configured to indicate that the predefined event occurred, if the pattern matching result indicates that said one of the one or more predefined audio patterns is found in each of the two or more audio microphone signals, and if the air pressure change is greater than a threshold value.

8. The system according to claim 1:

wherein the system further comprises an alarm call unit, wherein, if the evaluator indicates that the predefined event occurred, the alarm call unit is configured to conduct an automatic phone call, said automatic phone call by which the alarm call unit informs a recipient of the automatic phone call that the predefined event occurred, or wherein, if the evaluator indicates that the predefined event occurred, the alarm call unit is configured to send an alarm signal using wired communications or wireless communications, said alarm signal informing the recipient of the automatic phone call that the predefined event occurred.

9. The system according to claim 1:

wherein the system further comprises an alarm signal unit, wherein, if the evaluator indicates that the predefined event occurred, the alarm signal unit is configured to output at least one of an acoustic alarm signal and an optical alarm signal.

10. The system according to claim 1:

wherein the audio signal analyzer and the air pressure change determiner and the evaluator are wirelessly connected; or wherein the audio signal analyzer and the air pressure change determiner and the evaluator are integrated into one device.

11. The system according to claim 1:

wherein the system further comprises a mode setting module, being configured to set the system into a first mode, in which surveillance is active, and into a different, second more, in which surveillance is not active, wherein, if the system is in the first mode, the evaluator is configured to indicate, depending on the pattern matching result and depending on the air pressure change, that the predefined event occurred, and wherein, if the system is in a second mode, the evaluator is configured to not indicate that the predefined event occurred, irrespective of the pattern matching result and irrespective of the air pressure change.

12. The system according to claim 1:

wherein the barometric air pressure sensor is configured to generate the air pressure change signal by measuring a current air pressure and by determining the air pressure change from the current air pressure and from a previous air pressure.

13. The system according to claim 1:

wherein the microphone is configured to record the one or more audio microphone signals.

14. A method for surveillance, comprising:

receiving one or more audio microphone signals by a first sensor device;

determining a pattern matching result by determining whether the one or more audio microphone signals comprise at least one audio pattern of one or more predefined audio patterns;

receiving an air pressure change signal indicating an air pressure change by a second sensor device different from the first sensor device; or receiving an air pressure signal indicating a current air pressure by the second sensor device and determining the air pressure change from the air pressure signal indicating the current air pressure and from a previously received air pressure; and indicating, depending on the pattern matching result and depending on the air pressure change, that a predefined event occurred, wherein the one or more audio microphone signals and the air pressure change signal comprise different signals respectively received by the first sensor device and the second sensor device, wherein the first sensor device comprises a microphone and the second sensor device comprises a barometric air pressure sensor.

15. A non-transitory computer readable storage medium with an executable program stored thereon, the executable program including instructions to execute the method as claimed in claim 14 on one or more processors.

16. A system for surveillance, comprising:

an audio signal analyzer comprising a microphone device, wherein the audio signal analyzer is configured to receive one or more audio microphone signals at a first input, wherein the audio signal analyzer is configured to determine a pattern matching result by determining whether the one or more audio microphone signals comprise at least one audio pattern of one or more predefined audio patterns;

an air pressure analyzer configured to receive an air pressure signal from a barometric air pressure sensor different from the microphone device at a second input distinct from the first input, and configured to determine a pressure pattern matching from the received air pressure signal; and an evaluator, wherein the evaluator is configured to indicate, depending on the pattern matching result and depending on the determined pressure pattern, that a predefined event occurred.

17. The system according to claim 16, wherein the air pressure analyzer is configured to determine the pressure pattern based on an air pressure change from a previously received air pressure reading based on the air pressure signal and a current air pressure reading based on the air pressure signal.

18. The system according to claim 17, wherein the air pressure analyzer is configured to receive the air pressure signal indicating the current air pressure being a current barometric air pressure and is configured to determine the air pressure change being a barometric air pressure change from the signal indicating the current barometric air pressure and from a previously received barometric air pressure being the previously received air pressure.

19. The system according to claim 17:

wherein the barometric air pressure sensor is configured to measure the current air pressure to generate the air pressure signal.

* * * * *